US010292545B2

(12) United States Patent
Rodriguez

(10) Patent No.: US 10,292,545 B2
(45) Date of Patent: May 21, 2019

(54) CENTER-PULL DISPENSER SYSTEM

(71) Applicant: RD Textiles, LLC, Miami, FL (US)

(72) Inventor: Alexander Rodriguez, Miami, FL (US)

(73) Assignee: RD Textiles, LLC, Miami, FL (US)

( * ) Notice: Subject to any disclaimer, the term of this patent is extended or adjusted under 35 U.S.C. 154(b) by 132 days.

(21) Appl. No.: 15/356,100

(22) Filed: Nov. 18, 2016

(65) Prior Publication Data

US 2018/0141771 A1 May 24, 2018

(51) Int. Cl.

| | |
|---|---|
| ***A47K 10/38*** | (2006.01) |
| ***B65H 49/00*** | (2006.01) |
| ***B65H 49/08*** | (2006.01) |
| ***B65H 55/04*** | (2006.01) |
| ***B65H 57/18*** | (2006.01) |
| ***B65H 57/00*** | (2006.01) |
| ***B65H 55/00*** | (2006.01) |
| ***B65D 83/08*** | (2006.01) |
| *A47K 10/32* | (2006.01) |

(52) U.S. Cl.

CPC ..... *A47K 10/3818* (2013.01); *B65D 83/08* (2013.01); *B65H 49/00* (2013.01); *B65H 49/08* (2013.01); *B65H 55/00* (2013.01); *B65H 55/046* (2013.01); *B65H 57/00* (2013.01); *B65H 57/18* (2013.01); *A47K 2010/3206* (2013.01)

(58) Field of Classification Search

CPC ..... B65H 16/005; B65H 16/00; B65H 18/00; B65H 19/00; B65H 27/00; B65H 49/00; B65H 75/00; B65H 3/268; B65H 5/706; B65H 5/708; B65H 5/725; B65H 1/00; B65H 3/00; B65H 47/00; B65H 50/00; B65H 73/00; B65H 2575/00; B65H 2583/00; B65H 55/046; B65H 49/08; B65H 57/00; B65H 57/04; B65H 57/003; B65H 57/06; B65H 57/48; B65H 57/22; B65H 57/24; B65H 57/10; B65H 57/18; A47K 10/00; A47K 10/02; A47K 10/025; A47K 10/16; A47K 10/24; A47K 10/32; A47K 10/3643; A47K 10/3818

USPC ... 242/588.3, 132, 137, 596.8, 615.3, 615.4, 242/593; 221/33, 45, 62, 63; 222/105, 222/333, 63; 225/106, 52, 96.5; 232/43.3, 44

See application file for complete search history.

(56) References Cited

U.S. PATENT DOCUMENTS

| | | | |
|---|---|---|---|
| 2,713,938 | A | 7/1955 | Snyder |
| 3,399,761 | A | 9/1968 | Hayashi |
| 3,669,255 | A | 6/1972 | Raymus |
| 3,700,185 | A | 10/1972 | Hubbard et al. |

(Continued)

*Primary Examiner* — Michael R Mansen
*Assistant Examiner* — Raveen J Dias
(74) *Attorney, Agent, or Firm* — Akerman LLP

(57) ABSTRACT

A dispensing cap for a dispensing system may be adapted for dispensing a roll of longitudinally extending material arranged in a center-pull configuration. The dispensing cap may include a dispensing orifice. A first rim having an inner edge may define a wide end of the dispensing orifice. A second rim having an outer edge may define a narrow end of the dispensing orifice. One or more sidewalls may extend between the inner edge of the first rim and the outer edge of the second rim and define the dispensing orifice between the wide end and the narrow end. The dispensing cap may further include a dispensing slot that defines an opening through the second rim.

16 Claims, 11 Drawing Sheets

(56) References Cited

U.S. PATENT DOCUMENTS 3,746,276 A * 7/1973 Stotler ..... B65H 49/08 242/129
3,749,296 A * 7/1973 Harrison ..... A47K 10/3809 118/43
3,915,301 A 10/1975 Gray et al.
3,983,997 A 10/1976 Warshaw
4,009,845 A * 3/1977 Santucci ..... B65H 49/08 242/129.7
4,019,636 A * 4/1977 Wise ..... B65D 5/5004 206/396
4,171,047 A * 10/1979 Doyle ..... A47K 10/3818 118/506
4,219,129 A * 8/1980 Sedgwick ..... A47K 10/3818 118/43
4,373,687 A * 2/1983 Zicko ..... B65D 85/67 206/395
5,100,078 A * 3/1992 Clark ..... B65D 85/04 242/128
5,115,995 A * 5/1992 Hunt ..... B65H 57/12 242/137.1
5,129,514 A 7/1992 Lilley, Jr.
5,152,476 A * 10/1992 Moser ..... B65H 55/046 242/137.1
5,246,137 A * 9/1993 Schutz ..... A47K 10/3818 206/409
D341,079 S 11/1993 Crowe
5,273,184 A * 12/1993 Rizzuto ..... A47K 10/3818 221/286
5,310,083 A * 5/1994 Rizzuto ..... A47K 10/3818 221/303
5,520,347 A * 5/1996 Bass ..... B65H 49/08 242/137.1
5,715,971 A * 2/1998 Morand ..... A47K 10/3818 221/45
6,129,240 A * 10/2000 Morand ..... A47K 10/3818 206/409
6,145,782 A * 11/2000 King ..... A47K 10/3818 242/593
6,220,435 B1 * 4/2001 Nobile ..... A47K 10/3818 206/210
6,491,163 B1 * 12/2002 Grcic ..... B65D 85/676 206/403
6,576,305 B2 6/2003 Williams, Jr. et al.
6,702,213 B2 * 3/2004 Kotzur ..... B65D 5/5028 242/131.1
6,889,867 B1 * 5/2005 Smith ..... B65D 43/0212 221/306
7,156,334 B1 * 1/2007 Fore, Sr. ..... B65H 55/046 242/171
7,997,522 B2 * 8/2011 Titas ..... A47K 10/3818 221/33
9,061,814 B2 * 6/2015 Copp ..... B65D 85/04
9,113,760 B2 * 8/2015 Knapp ..... A47K 10/3818
9,248,952 B2 2/2016 Burrous et al.
2001/0036521 A1 11/2001 Williams, Jr. et al.
2004/0026284 A1 * 2/2004 Cote ..... B65D 5/18 206/397
2009/0014579 A1 * 1/2009 Bender ..... B23K 9/1333 242/615.4
2010/0206896 A1 * 8/2010 Ray ..... A47K 10/3818 221/45
2011/0042254 A1 * 2/2011 Gelmetti ..... B23K 9/133 206/398
2011/0248112 A1 * 10/2011 Corbett ..... B65H 49/08 242/174
2012/0234713 A1 * 9/2012 Nicklas ..... B21C 47/18 206/395
2013/0146696 A1 * 6/2013 Copp ..... B65H 55/046 242/164
2013/0161432 A1 * 6/2013 Mannella ..... B65H 57/12 242/171
2014/0061361 A1 * 3/2014 Marble ..... A47F 13/04 242/588.6
2014/0262866 A1 9/2014 Burrous et al.
2014/0262891 A1 * 9/2014 Babcock ..... B65D 85/04 206/409
2015/0048105 A1 2/2015 Gordon
2016/0101962 A1 * 4/2016 Moore ..... B65H 55/046 242/171
2017/0073180 A1 * 3/2017 Gelmetti ..... B65D 43/02

* cited by examiner

CENTER-PULL DISPENSER SYSTEM

TECHNICAL FIELD

The present disclosure relates to dispensing longitudinally extending materials that are arranged in a center-pull configuration. More specifically, the present disclosure relates to components and systems for dispensing longitudinally extending materials that arranged in a center-pull configuration.

BACKGROUND

Longitudinally extending materials such as textiles and cord-like materials may be organized into rolls that are coiled to provide a center-pull configuration that allows the materials to be paid out from the center of the roll. In some instances, this may allow orderly removal of the material without rotation or movement of the roll that may complicate the dispensing process.

SUMMARY

In one aspect, a dispensing cap for a dispensing system may be adapted for dispensing a roll of longitudinally extending material arranged in a center-pull configuration. The dispensing cap may include a dispensing orifice. A first rim having an inner edge may define a wide end of the dispensing orifice. A second rim having an outer edge may define a narrow end of the dispensing orifice. One or more sidewalls may extend between the inner edge of the first rim and the outer edge of the second rim and define the dispensing orifice between the wide end and the narrow end. The dispensing cap may further include a dispensing slot that defines an opening through the second rim. The dispensing orifice may have frustum conical dimensions. In one embodiment, the dispensing cap may be formed of PVC. The dispensing slot may include a raised skirt defining the opening. The raised skirt may be raised with respect to the second rim. In various embodiments, the dispensing slot has a length that is elongated relative to its width. The width of the dispensing slot may remain consistent between arcuate longitudinal ends of the dispensing slot. An area of the skirt may be greater than an area of the dispensing slot taken along a plane of the second rim. The dispensing cap may also include a perimeter lip positioned along an outer perimeter of the dispensing cap.

In another aspect a containment and dispensing system for a roll of longitudinally extending material arranged in a center-pull configuration includes a first end cap and a second end cap. The first end cap may be positioned at a first end of the roll, and the second end cap may be positioned at a second end of the roll. One or more sidewalls may extend around sides of the roll between the first end cap and the second end cap. The first end cap may include a dispensing cap having a dispensing orifice, a first rim, and a second rim. The first rim may include an inner edge defining a wide end of the dispensing orifice. The second rim may include an outer edge defining a narrow end of the dispensing orifice. One or more sidewalls may extend between the inner edge of the first rim and the outer edge of the second rim and define the dispensing orifice between the wide end and the narrow end. A dispensing slot may be define an opening through the second rim.

In one configuration, one or more of the one or more sidewalls extend onto respective outer surfaces of the first and second end caps to retain the first and second end caps at respective ends of the roll. The one or more sidewalls may include one or more sleeves of heat shrinkable PVC. The dispensing cap may be formed of PVC. The dispensing orifice may have frustum conical dimensions. The dispensing slot may include a raised skirt that is raised with respect to the second rim and that defines the opening. The dispensing slot may have a length that is elongated relative to its width. The width of the dispensing slot may remain consistent between arcuate longitudinal ends of the dispensing slot. An area of the skirt may be greater than an area of the dispensing slot taken along a plane of the second rim. A perimeter lip may be positioned along an outer perimeter of the dispensing cap.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

DESCRIPTION

Described herein are dispenser components and containment and dispensing systems for use with longitudinally extending materials coiled in a center-pull configuration.

Figure 1A:
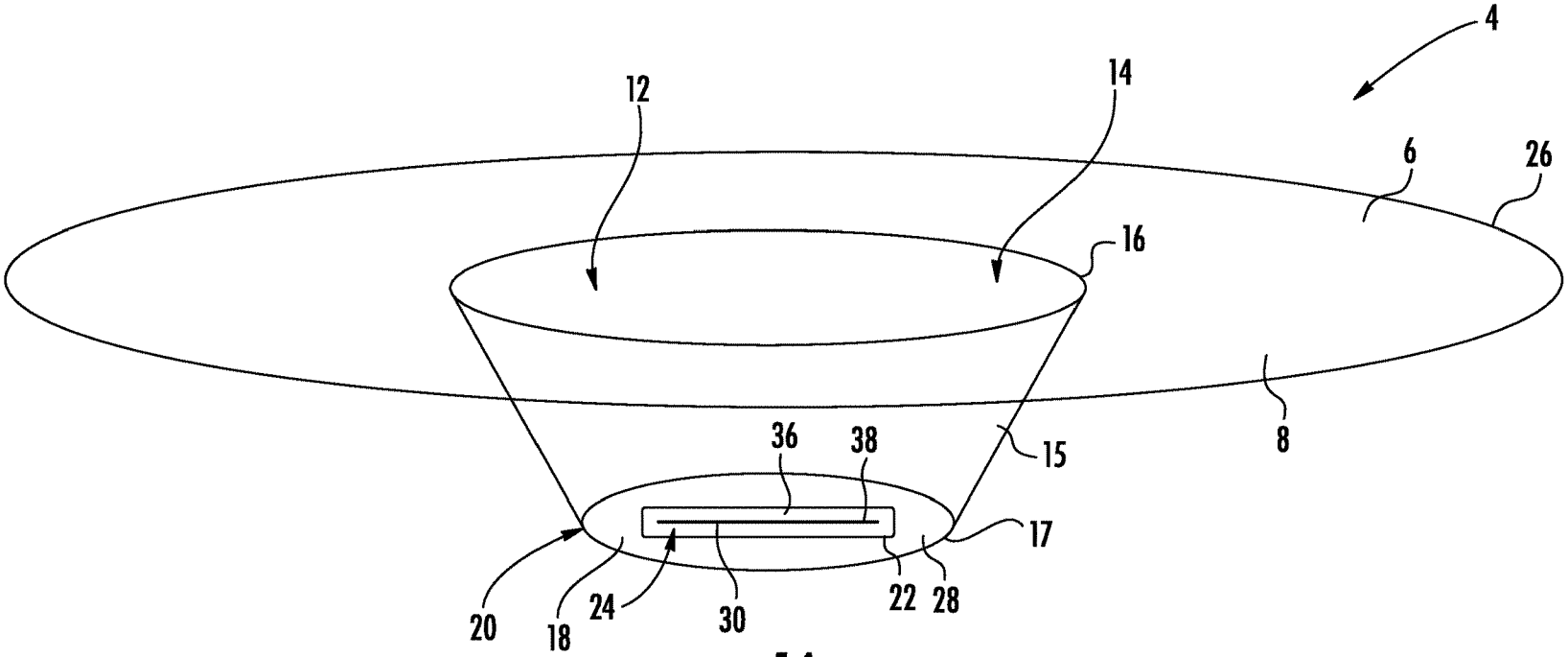
FIG. 1A is a side view in perspective of a dispenser cap according to various embodiments described herein.
Figure 1B:
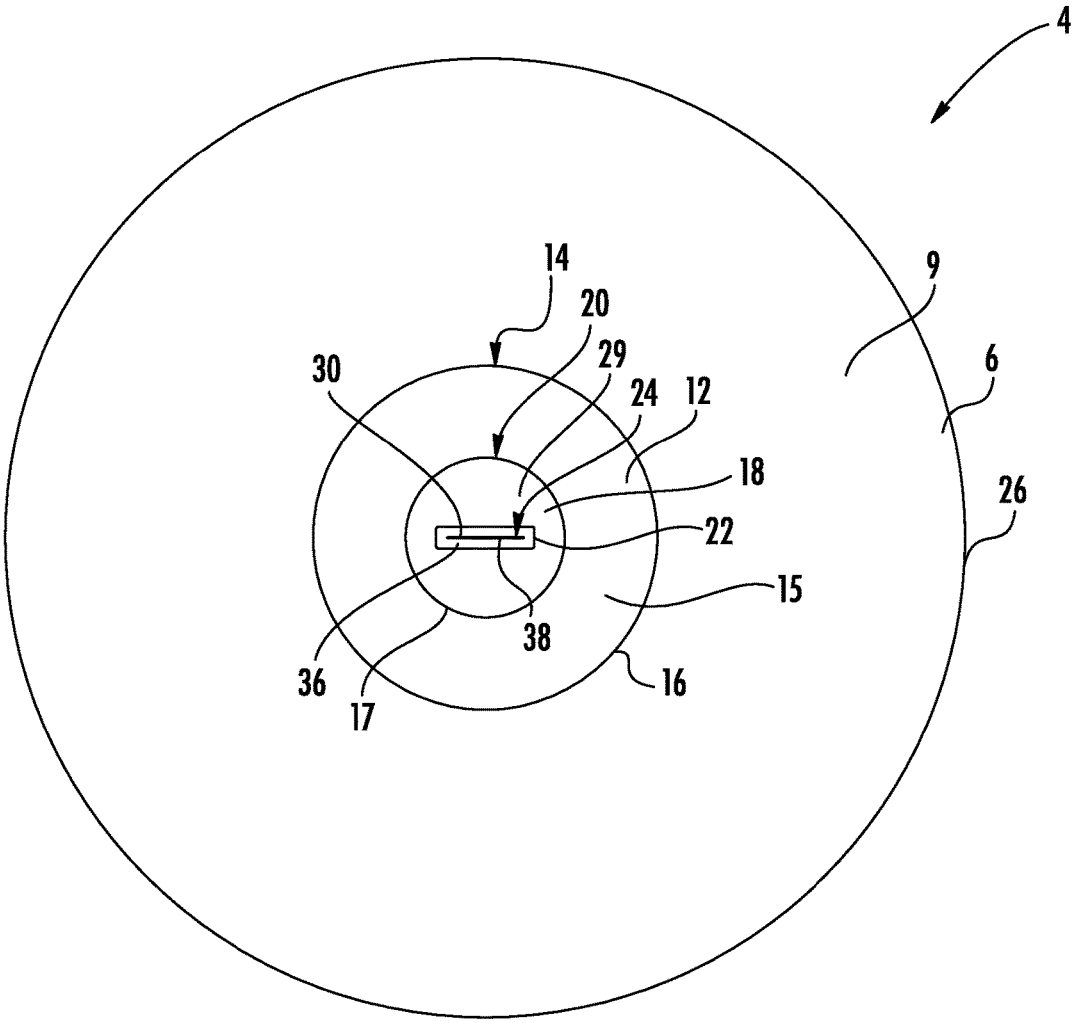
FIG. 1B is a top view of the dispenser cap shown in FIG. 1A.

With reference to FIGS. 1A & 1B, in various embodiments, a dispenser for dispensing a roll of longitudinally extending materials coiled in a center-pull configuration includes a dispenser cap 4. The dispenser cap 4 may include a first rim 6 having a first lower surface 8 and a first upper surface 9. The first rim 6 defines a wide end 14 of a dispensing orifice 12. One or more sidewalls 15 extend from the first rim 6, such as an edge 16 thereof, and angle toward an outer edge 17 of a second rim 18 that defines a narrow end 20 of the dispensing orifice 12. The second rim 18 has a perimeter edge 22 between which a dispensing slot 24 is positioned. The dispensing slot includes an opening 30 defined by a skirt 36. However, in other embodiments, the slot 24 does not include a skirt 36 and the opening 30 is defined by the perimeter edge 22 of the slot 24. The first rim 6 and the second rim 18 are generally positioned along parallel planes. However, in some embodiments, the first rim 6 and the second rim 18 are not positioned along parallel planes such that the respective planes angle toward, away, or both from each other at one or more points.

The dispenser cap 4 may be dimensioned such that it may be positioned over an end of the roll. For example, an outer perimeter 26 of the dispenser cap 4 may be dimensioned to extend across the end of the roll. In the illustrated embodiment, outer perimeter 26 of the dispenser cap 4 defines a circular or rounded shape. The shape defined by the outer perimeter 26 may typically conform to that of the end of the roll, e.g., to conserve space. Thus, in one embodiment, the illustrated dispenser cap 4 may be positioned over an end of a roll having a circular or rounded shape or horizontal cross-section. However, in some embodiments, other shapes may be used. For example, geometric, non-geometric, or free-form shapes may be used. In some embodiments, the outer perimeter 26 may substantially correspond to with an outer perimeter of the end of the roll such that, when positioned over the end of the roll, the outer perimeter 26 of the dispenser cap 4 corresponds with that of the outer perimeter of the end of the roll. In one configuration, the outer perimeter 26 may define a shape that includes one or more dimensions smaller than that of one or more dimensions across the end of the roll or a horizontal cross-section of the roll.

When positioned over the end of the roll, the longitudinally extending material may be pulled from the roll through the slot 24 at the narrow end 20 and then further extended through the wide end 14 of the dispensing orifice 12. In one embodiment, the largest dimension of the wide end 14 is greater than the largest dimension of the narrow end 20. In this or another embodiment, the wide end 14 has a greater area than the narrow end 20.

Figure 2:
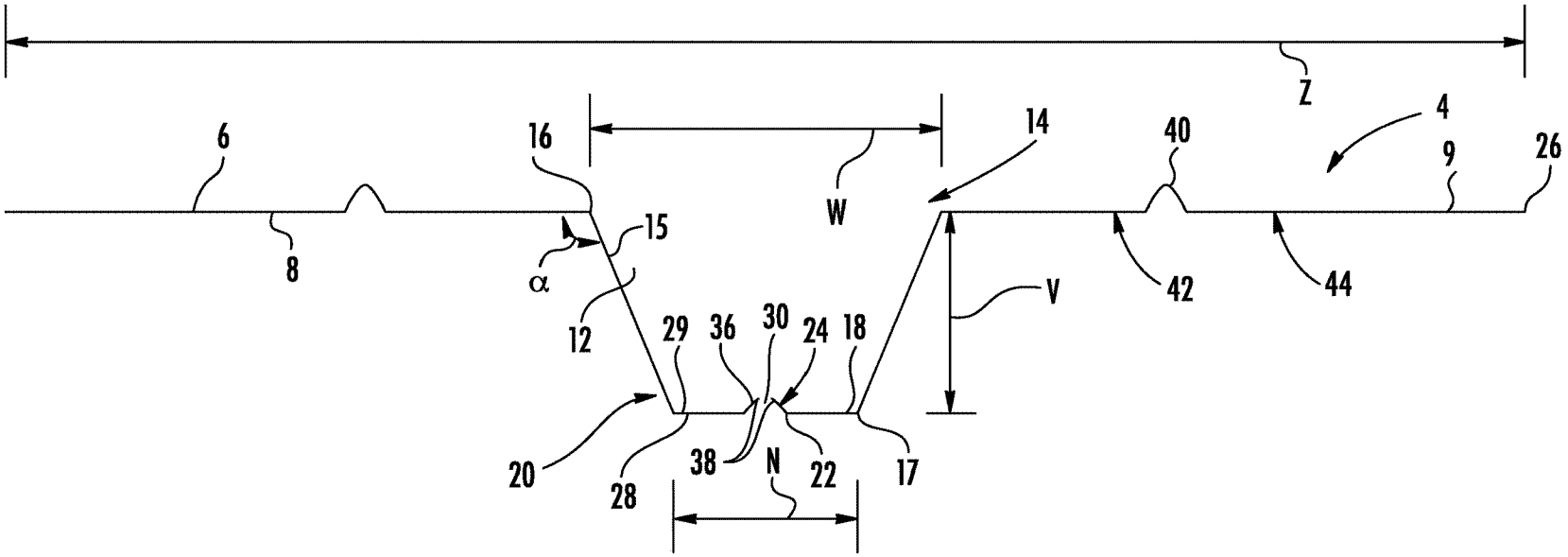
FIG. 2 is a side view cross-section of a dispenser cap according to various embodiments described herein.

FIG. 2 is a side plan view of a dispenser cap 4 according to various embodiments. It is to be understood that the dimensions and features described with respect to FIG. 2, as well as those described with respect to the other various embodiments, may be applied in a similar manner to the other various embodiments described herein where like features are indicated by like numbers. Dispenser caps 4 include a dispensing orifice 12 that preferably has truncated dimensions, which herein may refer to frustum conical, pyramidal frustum, spherical segment, or other truncated geometric or non-geometric shapes having a base end, one or more sides extending between the base end and a truncated end, wherein the mean interior angle with respect to the base along the length of the one or more sides is greater than 0 degrees and less than 90 degrees. Thus, the wide end 14 defined by the first rim 6, such as by edge 16, may correspond to a base of the truncated dimensions; the narrow end 20 defined by the second rim 18 may correspond to a truncated end of the truncated dimensions; and the one or more sidewalls 15 may correspond to sides of the truncated dimensions. The sidewalls 15 may extend from the first rim 6 to the second rim 18 at a mean angle (reference angle indicated by double arrow a) less than 180 degrees but greater than 90 degrees with respect to a first lower surface 8 of the first rim 6 (exterior to the orifice). The truncated dimensions of the dispensing orifice 12 may include one or more sidewalls 15 having curved or linear portions extending along their length or width dimensions. In various embodiments, the dispensing orifice 12 may resemble a truncated cone or pyramid. For example, the dispensing orifice 12 shown in FIG. 1A resembles a truncated cone and includes a sidewall 15 having linear length dimensions and curved width dimensions. In a further example, a first portion of a sidewall 15 may extend from the first rim 6 at an angle $\alpha$ that is different than a second portion of a sidewall 15. For instance, sidewalls 15 may have angled or curved surfaces that create different angles $\alpha$ with respect to the first rim 6 along the length or width of the sidewall 15.

The dispensing orifice 12 includes a vertical distance (indicated by double arrow V) between the wide end 14 or first rim 6 and the narrow end 20 or second rim 18. An area of the wide end 14 or the largest dimension thereof (indicated by double arrow W) may typically be larger than the area or largest dimension (indicated by double arrow N) of the narrow end 20, respectively. The shape of the wide end 14 defined by edge 16 may be the same or different than the shape of the narrow end 20. The narrow end 20 will typically be dimensioned such that it may be contained within the dimensions of the wide end 14 defined by edge 16. In certain embodiments, the dimensions of the wide end 14 correspond to smaller dimensions of the narrow end 20. In various embodiments, vertical distance V may be related to the angle $\alpha$ and length of the one or more sidewalls 15 that connect the first rim 6 and the second rim 18. In the embodiments illustrated in FIGS. 1A-2, vertical distance V is approximately the same as the diameter or largest dimension N at the narrow end 20. Other ratios of vertical distance V to diameter or largest dimension N may also be used, e.g., 1:3 to 3:1, 1:1 to 1:2, 1:1 to 2:1, 1:1.5, 0.75:1, 1:0.75. In the illustrated embodiment, the ratio of the diameter or largest dimension N of the narrow end 20 to the diameter or largest dimension W of the wide end 14 is 2:3. Other ratios of diameter or largest dimension N to diameter or largest dimension W may also be used, e.g., 0.25:1 to 0.9:1, 0.5:1 to 0.8:1, 0.6:1 to 0.7:1, 0.6:1, 0.7:1. In the illustrated embodiments, the ratio of the diameter or largest dimension W of the wide end 14 to the diameter or largest dimension Z of the cap 4 is approximately 1:4. Other ratios of diameter or largest dimension W to diameter or largest dimension Z of the cap 4 may also be used, e.g., 1:1.5 to 1:20, 1:2 to 1:15, 1:2 to 1:10, 1:2 to 1:6, 1:3 to 1:5, 1:3.5 to 1:4.5, 1:3, 1:5.

With continued reference to FIGS. 1A-2, the dispensing orifice 12 includes truncated dimensions similar to that of a conical frustum. In particular, the sidewall 15 is substantially linear along its length and maintains a consistent angle $\alpha$ (see, e.g., FIG. 2) with respect to the first rim 6 along its length that is less than 180 degrees and greater than 90 degrees. In the illustrated embodiments, angle $\alpha$ is approximately 97 degrees (e.g., +/−5%). In various embodiments, the sidewall 15 extends between the first rim 6 and the second rim 18 at an angle $\alpha$ between 95 degrees and 145 degrees, 95 degrees and 130 degrees, 95 degrees and 120 degrees, 95 degrees and 110 degrees, 95 degrees and 105 degrees, 95 degrees and 100 degrees, or 97 degrees. The sidewall 15 is curved along its width and extends completely around the edge 16 of the first rim 6. In these or other embodiments, multiple sidewalls 15 having curved surfaces along their width may extend between the first rim 6 and the second rim 18. In the illustrated embodiment, the first rim 6 and the second rim 18 extend along parallel planes such that the wide end 14 and narrow end 20 are located along the parallel planes. In some embodiments, the first rim 6 and the second rim 18 are not positioned along parallel planes such that the wide end 14 and narrow end 20 angle toward, away, or both from each other at one or more points.

As shown, the skirt 36 is flared or raised upward. The skirt 36 also includes a surface area greater than the area of the slot 24 along the plane of the narrow end 20. In one example, the opening 30 is formed by a slit or incision across the skirt 36 for the passage of material therethrough. In one embodiment, surface area of a raised skirt 36 may be less than the area of the slot 24 along the plane of the narrow end 20, e.g., to accommodate larger openings or shorter skirts 36. The width of the opening 30 may be approximately that of the largest cross-sectional width of the material to be dispensed. In some embodiments, the width of the opening is slightly less than the largest cross-sectional width of the material to be dispensed. For example, when the material is pulled through the opening 30, the material may compress in cross-section, expand the opening 30, or both. The skirt 36 may be arranged such that the friction between the material and the skirt 36 edge 38 is greater when the material is pulled downwardly compared to upward through the opening 30. For example, the edges 38 of the skirt 36 defining the opening 30 may extend or flare upwardly allowing upward passage of the material through the opening. In contrast, downward passage through the opening 30 may result in upwardly extending or flared edges 38 of the skirt 36 moving inwardly, decreasing the width of the opening 30 and leveraging the strength of the skirt 36 arranged in the raised configuration, such that the edges 38 of the skirt 36 engage the material in a clamping-like manner. Thus the structural design of the skirt 36 may directionally limit the passage of the material through the opening 30 by effectively increasing the rigidity of the slot 24 with respect to changes in the width of the opening 30 in response to the directional force applied to the slot 24 as a result of the passage or attempted passage of the material through the opening 30. Other arrangements may be used. For example, a skirt 36 may be flared or raised downward. In one embodiment, the skirt 36 extends along the plane of the narrow end 20 and includes an area less than the area of the slot 24 along the plane of the narrow end. In a further embodiment, a skirt 36 may include one or more flaps that extend from one more edges of the slot 24. The flaps may include limited directional bending similar to that of the skirt 36 described above responsive to the directional passage or attempted passage of material from the opening 30. A flap may extend from the perimeter edge 22 of the slot 24 along one or two sides and may include one or three unconnected sides. In one embodiment, a skirt 36 is "H" cut and includes two flaps, each having three unconnected sides. In one arrangement, the combined width of the two flaps across the width of the opening 30 may be greater than the width of the opening 30.

Figure 3:
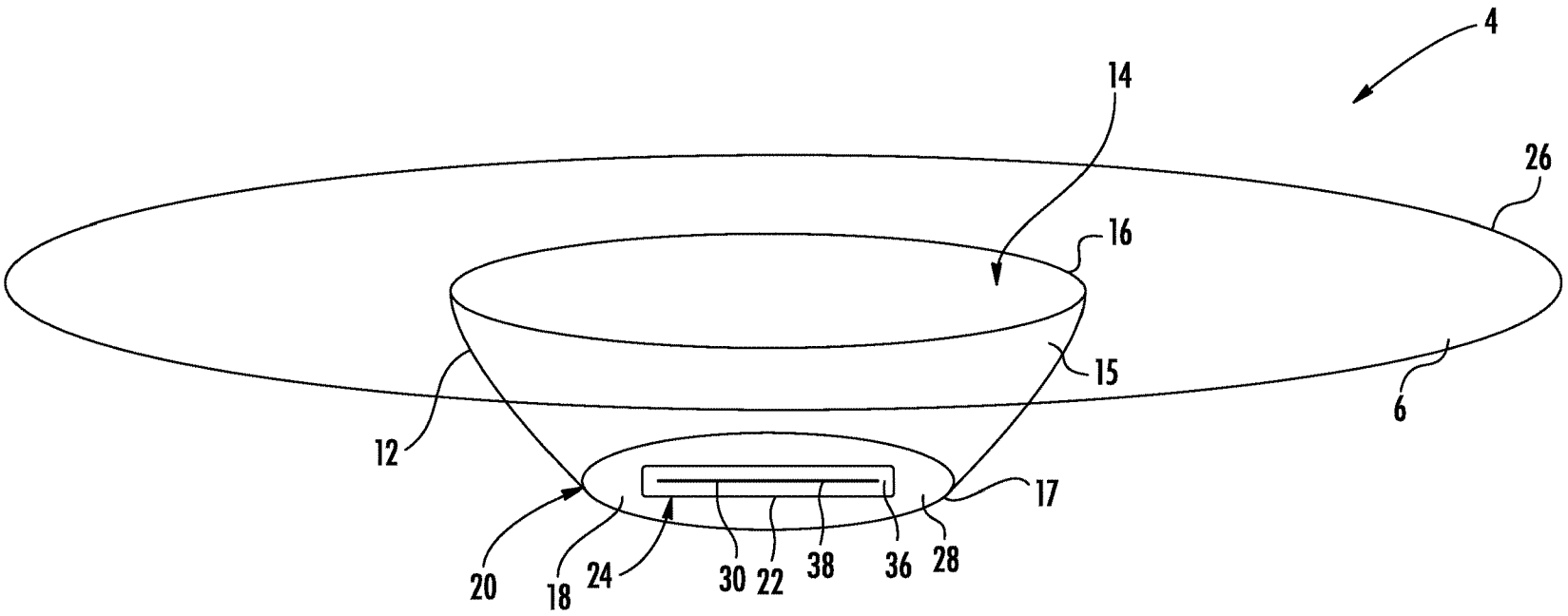
FIG. 3 is a side view in perspective of a dispenser cap according to various embodiments described herein.

FIG. 3 illustrates one example of the various truncated dimensions that may be used with respect to a dispensing orifice 12 according to various embodiments. The dispenser cap 4 shown in FIG. 3 is similar to the dispenser cap 4 described above with respect to FIG. 1A except the dispensing orifice 12 includes truncated dimensions wherein the sidewall 15 includes a curved surface along its length between the first rim 6 and the second rim 18 as well as along its width. The curved surface creates different angles $\alpha$ (see, e.g., FIG. 2) with respect to the first rim 6 along the length of the sidewall 15 wherein the mean angle $\alpha$ is less than 180 degrees and greater than 90 degrees. For example, the sidewall 15 initially extends from the first rim 6 at an angle $\alpha$ slightly less than 90 degrees. The angle $\alpha$ thereafter increases along the length of the sidewall 15 to approximately 140 degrees. The truncated dimensions of the dispensing orifice 12 shown in FIG. 3 may be similar to that of a spherical segment. In further embodiments, the angle $\alpha$ the sidewall 15 extends from the first rim 6 may increase toward the second rim 18, increase and then decrease toward the second rim 18, or decrease and then increase toward the second rim 18 along all or a portion of its length.

In the embodiment shown in FIG. 3, the resulting dimensions of the wide end 14 and the narrow end 20 of the dispensing orifice 12 correspond with those shown in FIG. 1A and, hence, also FIG. 1B. However, a vertical distance V (see, e.g., FIG. 2) between the first rim 6 and second rim 18 is less than a vertical distance V (see, e.g., FIG. 2) between the first rim 6 and the second rim 18 of the dispensing orifice 12 shown in FIG. 1A. The first rim 6 and the second rim 18 also extend along parallel planes such that the wide end 14 and narrow end 20 are located along parallel planes. In some embodiments, the first rim 6 and the second rim 18 are not positioned along parallel planes such that the wide end 14 and narrow end 20 angle toward, away, or both from each other at one or more points.

Figure 4A:
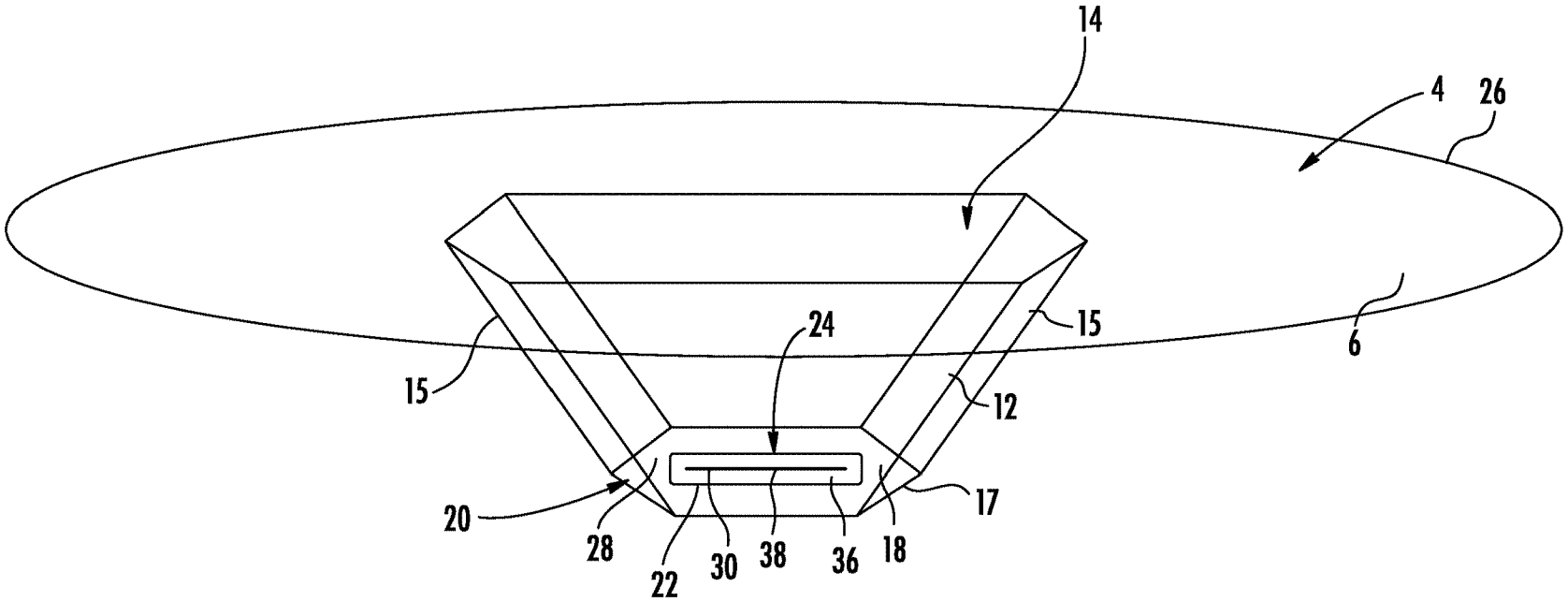
FIG. 4A is a side view in perspective of a dispenser cap according to various embodiments described herein.
Figure 4B:
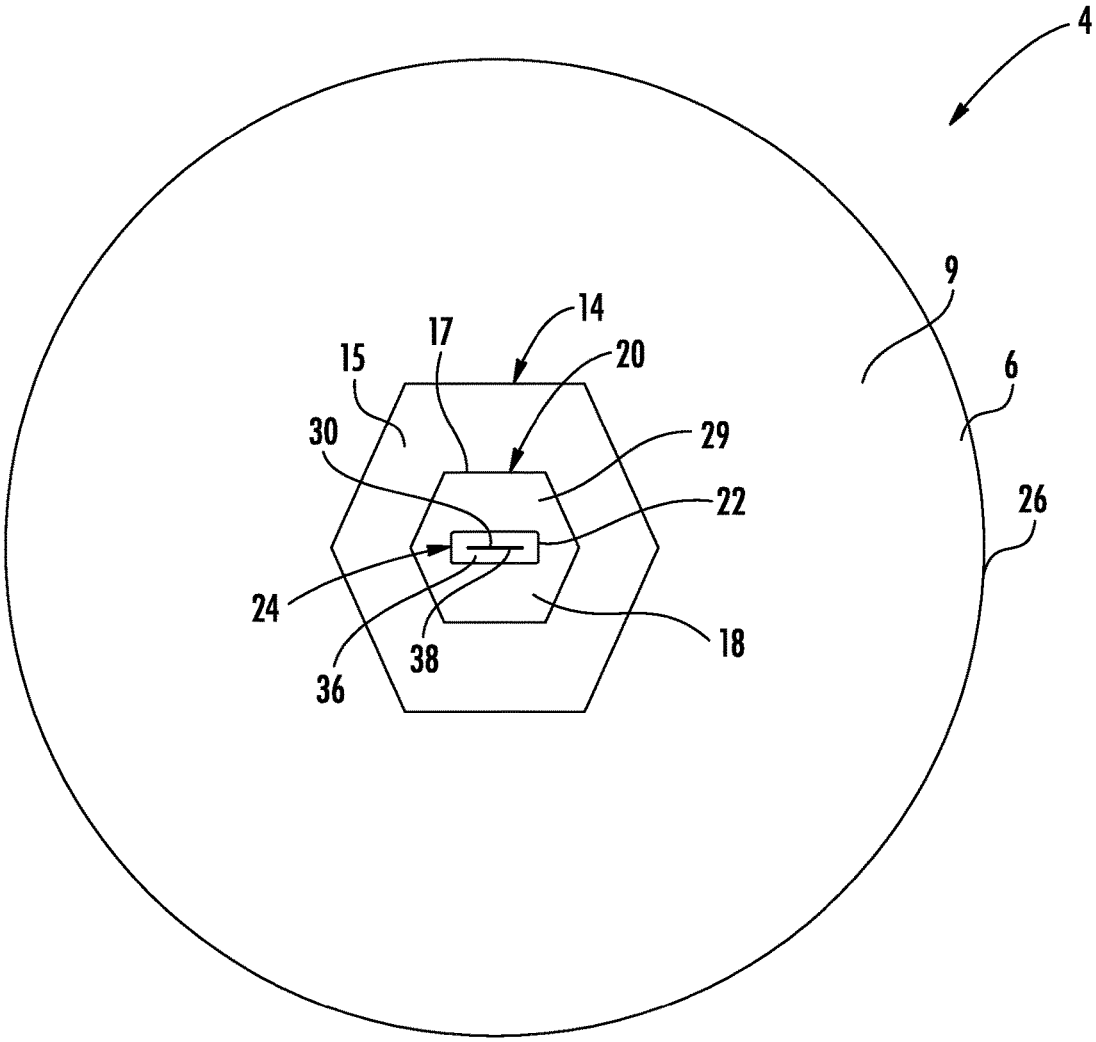
FIG. 4B is a top view of the dispenser cap shown in FIG. 4A.

FIGS. 4A & 4B illustrate one example of the various truncated dimensions that may be used with respect to a dispensing orifice 12 according to various embodiments. The dispenser cap 4 shown in FIGS. 4A & 4B is similar to the dispenser caps 4 shown in FIGS. 1A-3 except the dispensing orifice 12 includes truncated dimensions similar to that of a pyramidal frustum wherein both the first rim 6 and second rim 18 are multi-sided and define multi-sided geometric shapes. Specifically, both the wide end 14 and narrow end 20 are hexagonal, and six sidewalls 15 extend between the first rim 6 and the second rim 18 such that the first rim 6 defines a hexagonal wide end 14 and the second rim 18 defines a hexagonal narrow end 20 having smaller corresponding dimensions with those of the hexagonal wide end 14. The sidewalls 15 are relatively straight or linear along their length and maintain a consistent angle $\alpha$ (see, e.g., FIG. 2) with respect to the first rim 6 along their length that is less than 180 degrees and greater than 90 degrees. In particular, the sidewalls 15 extends between the first rim 6 and the second rim 18 at an angle $\alpha$ between 130 degrees and 145 degrees, or approximately 140 degrees. In various embodiments, a sidewall 15 extends from the second rim 18 at an angle $\alpha$ between 110 degrees and 160 degrees, 110 degrees and 150 degrees, 110 degrees and 140 degrees, 110 degrees and 130 degrees, 110 degrees and 120 degrees, 120 degrees and 160 degrees, 120 degrees and 150 degrees, 120 degrees and 140 degrees, 130 degrees and 160 degrees, 130 degrees and 150 degrees, 130 degrees and 140 degrees, 140 degrees and 160 degrees. In the illustrated embodiment, the first rim 6 and the second rim 18 also extend along parallel planes such that the wide end 14 and narrow end 20 are located along parallel planes. In some embodiments, the first rim 6 and the second rim 18 are not positioned along parallel planes such that the wide end 14 and narrow end 20 angle toward, away, or both from each other at one or more points.

Figure 5A:
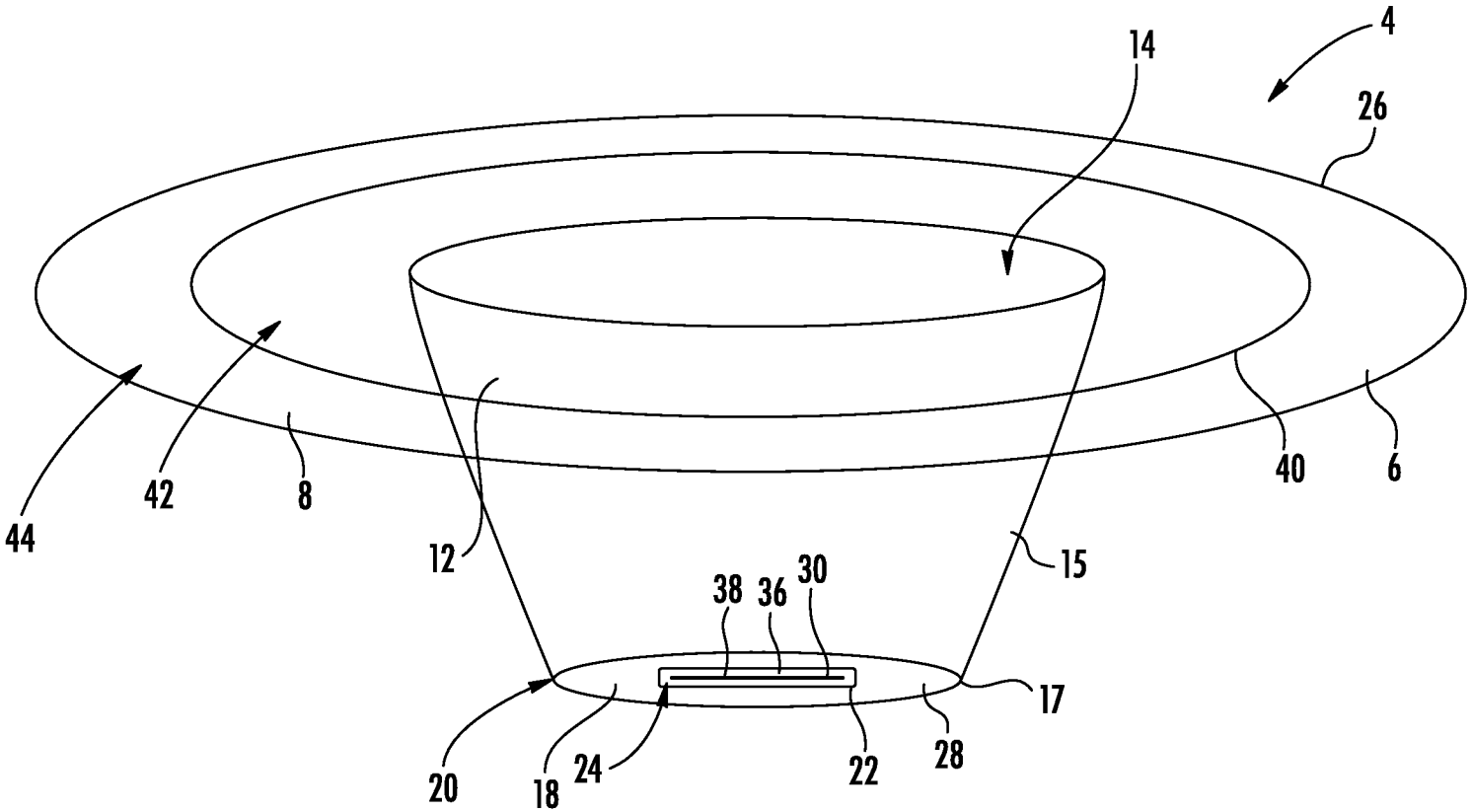
FIG. 5A is a side view in perspective of a dispenser cap according to various embodiments described herein.
Figure 5B:
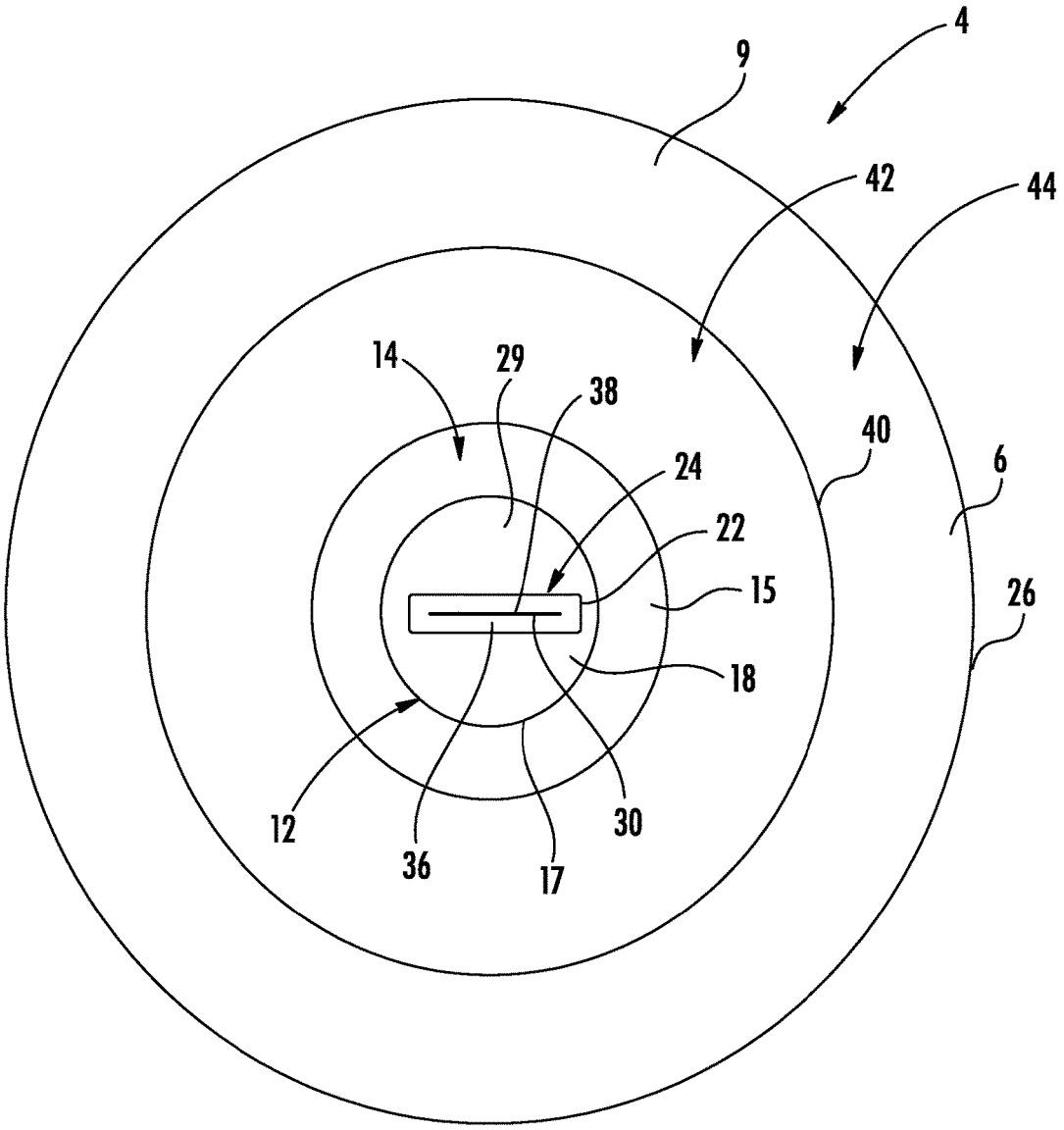
FIG. 5B is a top view of the dispenser cap shown in FIG. 5A.

FIGS. 5A & 5B illustrate a further embodiment of the dispenser cap 4 described above with respect to FIGS. 1A & 1B including a raised ridge 40 along the first rim 6. The raised ridge 40 forms a ring, as also depicted in FIG. 2, that divides the first rim 6 into an inner portion 42 and an outer portion 44. In further embodiments, the dispenser caps 4 described above with respect to FIGS. 3-4B may include a ridge 40.

In other embodiments, the dispenser cap 4 may include additional features. For example, the dispenser cap 4 may include one or more additional rims. In one embodiment, a third rim may be positioned outwardly of the first rim 6. One or more sidewalls may extend from the outer perimeter of the first rim 6 to the third rim. The third rim may be positioned along a plane above or below the second rim. In one embodiment, the third rim or another rim may be contoured to more proximally nest with the roll. Additional rims may also be included.

Figure 6:
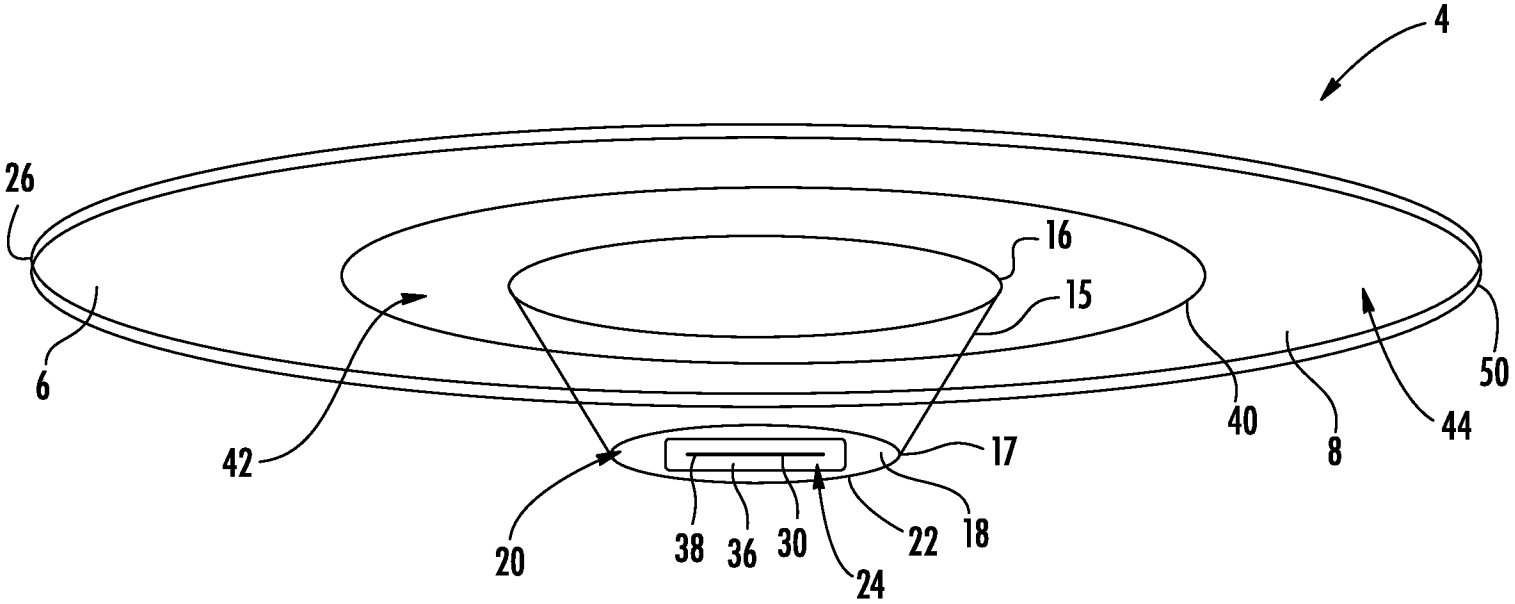
FIG. 6 is a side view in perspective of a dispenser cap according to various embodiments described herein.

FIG. 6 illustrates a further embodiment of the dispenser cap 4 described above with respect to FIGS. 1A-2, 4A, & 4B that includes a perimeter lip 50. The perimeter lip 50 may extend from the outer perimeter 26 of the dispenser cap 4, which in this embodiment is defined by the outer edge 17 of the first rim 6. However, in some embodiments, a perimeter lip 50 may extend from other perimeters or first lower surface 8 or second lower surface 28 of the dispenser cap 4. In one embodiment, a perimeter lip 50 extends around the dispenser cap 4 from the first lower surface 8 of the first rim 6 and defines a perimeter that does not extend from the outermost edge, or perimeter 26, of the dispenser cap 4 along all or a portion of its length and thus may be entirely or at least partially confined within the outer perimeter 26 of the dispenser cap 4.

Figure 7C:
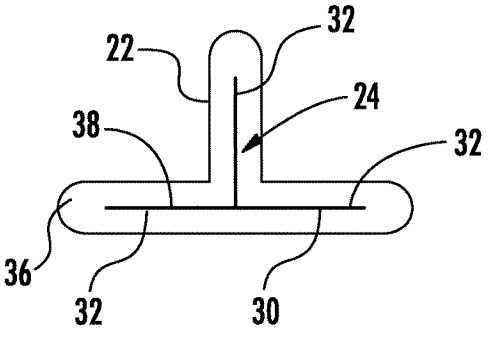
FIG. 7C illustrates a configuration of a dispenser slot according to various embodiments described herein.
Figure 7B:
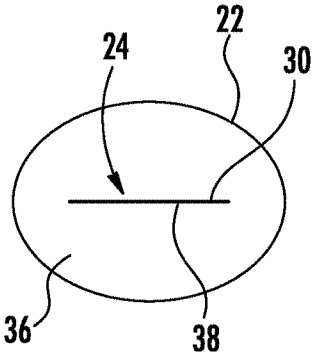
FIG. 7B illustrates a configuration of a dispenser slot according to various embodiments described herein.
Figure 7A:
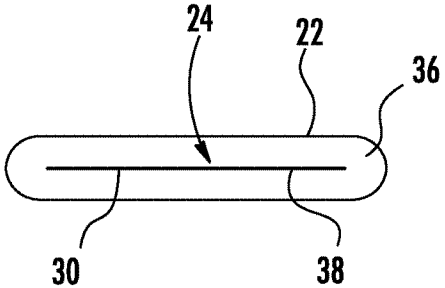
FIG. 7A illustrates a configuration of a dispenser slot according to various embodiments described herein.
Figure 7E:
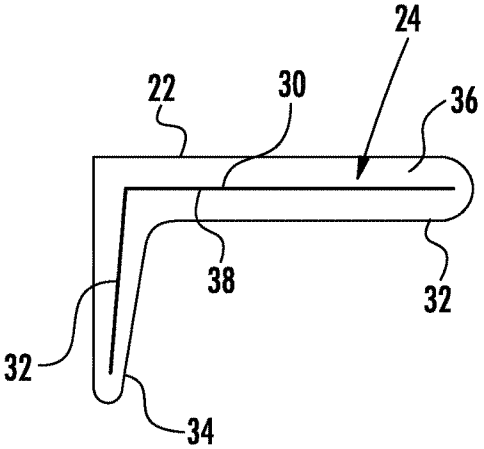
FIG. 7E illustrates a configuration of a dispenser slot according to various embodiments described herein.
Figure 7D:
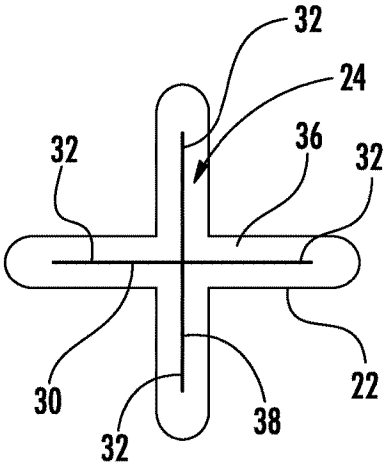
FIG. 7D illustrates a configuration of a dispenser slot according to various embodiments described herein.

As introduced above, a dispensing slot 24 is positioned at the narrow end 20 of the dispensing orifice 12 and is located inside perimeter edge 22 of the second rim 18. The dispensing slot 24 includes an opening 30 through which longitudinally extending material may be paid out from a roll. The opening 30 may be defined by a skirt 36 as described above and elsewhere herein. The slot 24 may include various cross-sectional shapes and dimensions. For example, FIG. 7A illustrates a dispensing slot 24 having an "I" configuration including an oblong opening similar to the dispensing slots 24 shown in FIGS. 1A, 1B, & 3A-6. In particular, the dispensing slot 24 includes an elongated length relative to its width. The width of the dispensing slot 24 remains consistent between arcuate longitudinal ends of the dispensing slot 24. The skirt 36 may be raised, e.g., bubble upwardly, from the narrow end 20. In some embodiments, the dispenser cap 4, such as any of those described above, may include a dispensing slot 24 having other configurations. For example, FIG. 7B illustrates a dispensing slot 24 having an oval-shaped configuration. In further examples the slot 24 may include multiple arms 32. In various embodiments, arms 32 may be arranged in a general "H", "L", "J", "E", "K", "V", "U", "X", "Y", "S", or "Z" configuration. FIG. 7C illustrates a dispensing slot 24 having multiple arms 32 arranged in a general "T" configuration. FIG. 7D illustrates another example of a dispensing slot 24 having multiple arms 32 wherein the arms 32 are arranged in a general "+" configuration. In some embodiments, other configurations and shapes may be used. In some of the above embodiments or another embodiment, the width of a dispensing slot 24 may increases or decreases along a portion thereof, e.g., along an arm 32. For example, FIG. 7E illustrates a dispensing slot 24 wherein a width of an arm 32 decreases toward one end 34 of the arm 32 to allow material to be wedged or compressed into the decreased width to hold the material in place, e.g., to prevent the material from falling back through the dispensing slot 24 or to hold the material for cutting. Thus, the dispensing slot 24 may progressively decrease in width along an arm 32 to allow a user to progressively wedge the material into the decreased width when desired. The width of an opening 30 may similarly decrease or a skirt may increase in length with respect to the plane of the narrow end 20 along a portion of the slot 24.

In some embodiments, all or a portion of the perimeter edge 22 of the second rim 18 defining the slot 24, in embodiments without a skirt 36, or edge 38 of a skirt 36 may be textured to interface with material. For example, edge 38 or perimeter edge 22 along the skirt 36 or second lower surface 28, or roll oriented side of the dispensing slot 24, may be smooth to allow the material to easily pass through the dispenser slot 24. In this or another embodiment, an upper edge 38 of the skirt 36 or a second upper surface 29 or edge 38 or perimeter edge 22 on a non-roll oriented side of the dispensing slot 24 may be rough or textured to interact with the material in a directional manner such that when pulled back through the dispenser slot 24 the perimeter edge 22 engages the material to obstruct or prevent the material from passing back through the dispenser slot 24 under its own weight. In some embodiments, the perimeter edge 22 of the slot 24 or skirt 36 along both the second lower surface 28 and second upper surface 29 is smooth. In one example, the dispenser slot 24 may increase or decrease in width from the second lower surface 28 to the second upper surface 29 of the dispenser slot 24.

The dispenser cap 4 may be formed from a suitably rigid material sufficient to retain the shape of the dispenser cap 4 while material is paid out through the dispensing orifice 12. In one example, the dispenser cap 4 is formed of a polymer such as a thermoformed PVC. In another example, the dispenser cap 4 may include one or more materials in addition to or instead of a polymer, such as a metallic, ceramic, paper, wood, or textile.

Figure 8:
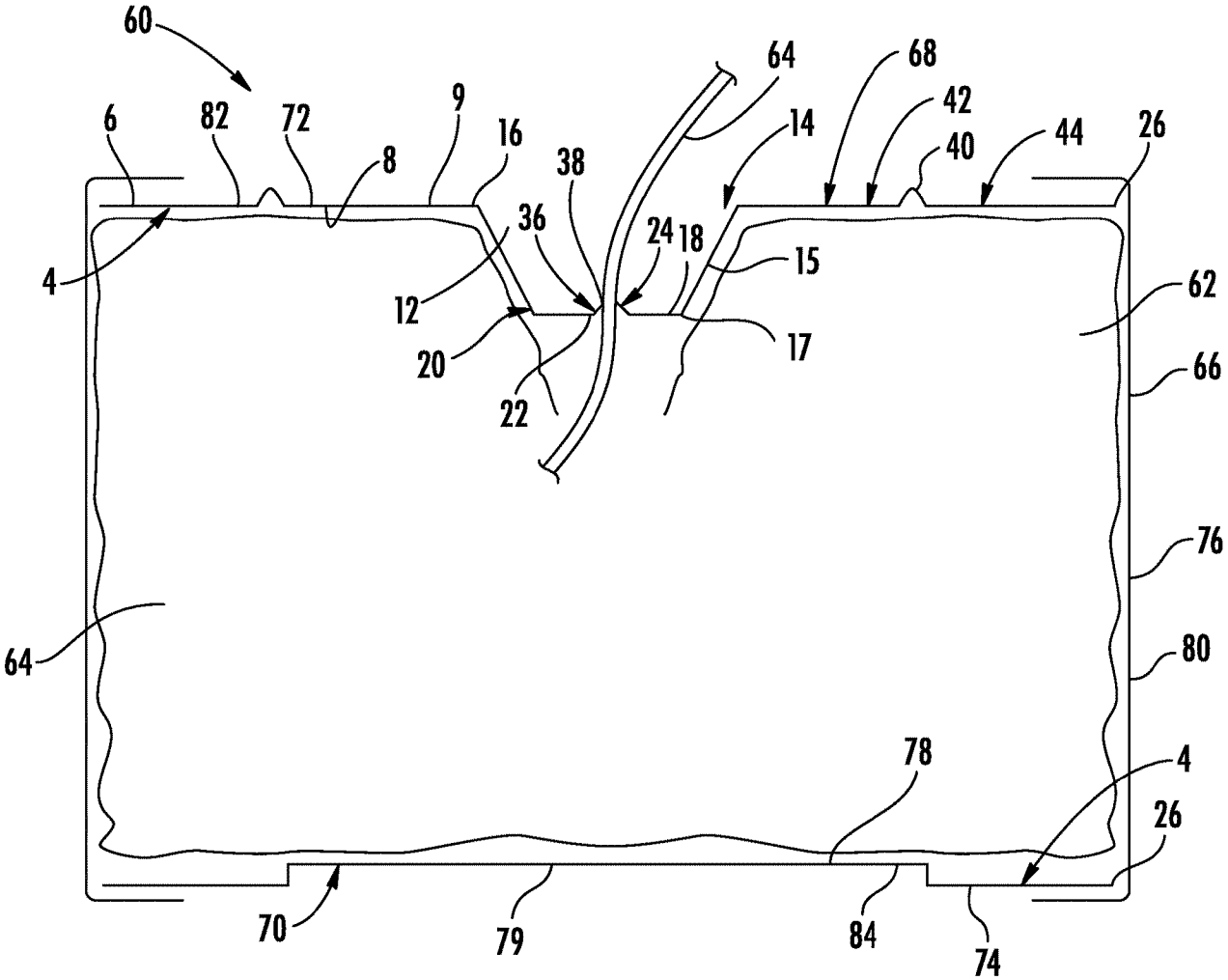
FIG. 8 illustrates a containment and dispenser system according to various embodiments described herein.

With reference to FIG. 8, a containment and dispenser system 60 includes a dispenser cap 4 as described herein. The system 60 may be configured to contain the roll 62 as well as dispense the material 64. The system 60 may be assembled to provide a rigid outer container 66 that maintains its form while the material 64 is paid out from the container 66 via the dispensing orifice 12. The container 66 may be constructed to protect the roll 62 and provide resistance to intrusion into the container 66 by water or debris. In various embodiments, the container 66 may be further constructed to resist shock. For example, the embodiment described with respect to FIG. 8 is structured to sustain falls up to 6 ft. while maintaining containment and dispensing functionality even when the fall occurs after most of the roll 62 has been dispensed.

The containment and dispenser system 60 shown in FIG. 8 includes a first end 68 and a second end 70. The first end 68 includes a first end cap 72 comprising a dispenser cap 4. The second end 70 includes a second end cap 74. The first end cap 72 and second end cap 74 may be constructed from materials such as those described above with respect to the various embodiments of the dispenser cap 4. One or more sidewalls 76 extend between the two end caps 72, 74. The second end cap 74 may include an upper surface 78 and a lower surface 79. The upper surface 78 may be flat or may be contoured to conform to dimensions of the roll 62, e.g., to nest with the roll 62. In some embodiments, the second end cap 74 may also comprise a dispenser cap 4. In one embodiment, the second end 70 does not include a second end cap 74 and the sidewalls 76 extend along all or a portion of the second end 70. The sidewalls 76 may comprise the same or different material than the dispenser cap 4 or second end cap 74. In the illustrated embodiment, the sidewalls 76 comprise one or more sleeves 80 of heat shrinkable PVC that extend above the dispenser cap 4 and below the second end cap 74, along outer perimeters 26 of the outer surfaces thereof to retain the end caps 72, 74 at the respective ends 68, 70. The heat shrunk sidewalls 76 may conform to the sides of the roll 62 to provide sturdy and efficient containment. The sidewalls 76 are approximately 0.04 mm thick. However, other thicknesses may be used, such as thicknesses of heat shrink PVC greater than 0.04 mm thick. Other materials may be used to form the sidewalls 76 that provide approximately equivalent or greater rigidity than the heat shrinkable PVC.

In one embodiment, a method of packaging a roll 62 of longitudinally extending material 64 coiled in a center-pull configuration comprises positioning a dispenser cap 4 at a first end of the roll 62 and placing a sleeve 80 of heat shrinkable polymer around the sides of the roll 62. The sleeve 80 may extend at least partially beyond the first end of the roll 62. The method may further include applying heat to cause the sleeve 80 to shrink and conform to the roll 62. The heat may also cause the portion of the sleeve 80 extending beyond the first end of the roll to conform to the first end 68, above the outer surface 82 of the dispenser cap 4, to thereby retain the dispenser cap 4 at the first end 68. In some embodiments, the sleeve 80 includes a bottom, e.g., the sleeve 80 may be in the form of a heat shrinkable bag having an open end. The bottom of the sleeve 80 may form around and contain a second end of the roll 62. In the illustrated embodiment, the sleeve 80 includes two open ends. In such a configuration, a method of packaging the roll 62 may also include positioning a second end cap 74 at the second end of the roll such that the sleeve 80 extends at least partially beyond the second end 70 and applying heat to cause the portion of the sleeve 80 extending beyond the second end 70 to conform to the second end 70, below or on the outer side 84 of the second end cap 74, to thereby retain the second end cap 74 at the second end 70. In the embodiment illustrated in FIG. 8, two sleeves of 0.02 mm heat shrinkable PVC are shrunk to conform to the shape of the roll 62.

The containment and dispenser system 60 described herein may allow a single person to dispense material 64 from the container. The dispensing orifice 12 may beneficially prevent the material 64 from falling back through the slot 24 and allow a portion of the material 64 to always extend from the orifice 12 until completely paid out. Thus, a user may pay out material 64 and then cut a desired length of the material 64 while leaving a remaining paid out portion of the material 64 extended from the dispensing orifice 12 for subsequent dispensing of the remaining roll 62. The system 60 may further be scalable to desired materials 64 and roll sizes. For example, the various dimensions of the dispenser cap 4 may be increased, decreased, or modified for containment and dispensing of rope, cable, cord, yarn, twine, ribbon, textiles or fabrics, for example.

Any references to "various embodiments," "certain embodiments," "some embodiments," "one example," "one embodiment," "an example," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not necessarily refer to the same embodiment. Furthermore, the phrases "in one such embodiment" or "in certain such embodiments," or "in one example," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise. Additionally, the grammatical conjunctions "and" and "or" are used herein according to their accepted usage. By way of example, "x and y" refers to "x" and "y". On the other hand, "x or y" refers to "x", "y", or both "x" and "y", whereas "either x or y" refers to exclusivity.

What is claimed is:

1. A dispensing cap for a dispensing system for dispensing a roll of longitudinally extending material arranged in a center-pull configuration, the dispensing cap comprising:

a dispensing orifice;

a first rim having an inner edge defining a wide end of the dispensing orifice;

a second rim having an outer edge defining a narrow end of the dispensing orifice;

one or more sidewalls extending between the inner edge of the first rim and the outer edge of the second rim and defining the dispensing orifice between the wide end and the narrow end; and a dispensing slot defining an opening through the second rim, wherein the dispensing slot comprises a raised skirt that is raised and extends upward from the second rim towards the first rim, wherein the skirt defines the opening, wherein the opening has a width that is less than a largest cross-sectional width of the longitudinally extending material, and wherein the skirt includes edges that are in contact with and clamp onto a portion of the longitudinally extending material that extends out of the opening towards the first rim.

2. The dispensing cap of claim 1, wherein the dispensing orifice has frustum conical dimensions.

3. The dispensing cap of claim 1, wherein the dispensing cap comprises PVC.

4. The dispensing cap of claim 1, wherein the dispensing slot has a length that is elongated relative to its width.

5. The dispensing cap of claim 4, wherein the width of the dispensing slot remains consistent between arcuate longitudinal ends of the dispensing slot.

6. The dispenser cap of claim 4, wherein an area of the skirt is greater than an area of the dispensing slot taken along a plane of the second rim.

7. The dispensing cap of claim 6, further comprise of a perimeter lip positioned along an outer perimeter of the dispensing cap.

8. A containment and dispensing system for a roll of longitudinally extending material arranged in a center-pull configuration, the system comprising:

a first end cap positioned at a first end of the roll;

a second end cap positioned at a second end of the roll; and one or more sidewalls extending around sides of the roll between the first end cap and the second end cap, wherein the first end cap comprises a dispensing cap, the dispensing cap comprising a dispensing orifice, a first rim having an inner edge defining a wide end of the dispensing orifice, a second rim positioned in-between the first end cap and the second end cap, the second rim having an outer edge defining a narrow end of the dispensing orifice, one or more sidewalls extending between the inner edge of the first rim and the outer edge of the second rim and defining the dispensing orifice between the wide end and the narrow end, and a dispensing slot defining an opening through the second rim, wherein the dispensing slot comprises a raised skirt that is raised and extends upward from the second rim towards the first rim, wherein the skirt defines the opening, wherein the opening has a width that is less than a largest cross-sectional width of the longitudinally extending material, and wherein the skirt includes edges that are in contact with and clamp onto a portion of the longitudinally extending material that extends out of the opening towards the first rim.

9. The system of claim 8, wherein one or more of the one or more sidewalls extend onto respective outer surfaces of the first and second end caps to retain the first and second end caps at respective ends of the roll.

10. The system of claim 9, wherein the one or more sidewalls comprise one or more sleeves of heat shrinkable PVC.

11. The system of claim 8, wherein the dispensing orifice has frustum conical dimensions.

12. The system of claim 8, wherein the dispensing cap comprises PVC.

13. The system of claim 8, wherein the dispensing slot has a length that is elongated relative to its width.

14. The system of claim 13, wherein the width of the dispensing slot remains consistent between arcuate longitudinal ends of the dispensing slot.

15. The dispenser cap of claim 13, wherein an area of the skirt is greater than an area of the dispensing slot taken along a plane of the second rim.

16. The system of claim 15, further comprise of a perimeter lip positioned along an outer perimeter of the dispensing cap.

* * * * *